US008812263B2

(12) United States Patent
Togano et al.

(10) Patent No.: US 8,812,263 B2
(45) **Date of Patent: *Aug. 19, 2014**

(54) CENTRIFUGAL CHILLER PERFORMANCE EVALUATION SYSTEM

(75) Inventors: Yoshie Togano, Tokyo (JP); Kenji Ueda, Tokyo (JP); Minoru Matsuo, Tokyo (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 536 days.

This patent is subject to a terminal disclaimer.

(21) Appl. No.: 13/043,013

(22) Filed: Mar. 8, 2011

(65) Prior Publication Data

US 2012/0029889 A1 Feb. 2, 2012

(51) Int. Cl.
*G06F 17/10* (2006.01)

(52) U.S. Cl.
USPC ..... 702/182

(58) Field of Classification Search
USPC ..... 702/99, 130, 136, 182, 183, 185; 62/127
See application file for complete search history.

(56) References Cited

U.S. PATENT DOCUMENTS

| | | | | |
|---|---|---|---|---|
| 4,768,346 | A * | 9/1988 | Mathur | 62/127 |
| 4,885,914 | A | 12/1989 | Pearman | |
| 5,083,438 | A | 1/1992 | McMullin | |
| 2010/0180629 | A1 | 7/2010 | Ueda et al. | |
| 2011/0120162 | A1 * | 5/2011 | Ueda et al. | 62/228.1 |

FOREIGN PATENT DOCUMENTS

| | | | |
|---|---|---|---|
| CN | 1629495 | A | 6/2005 |
| JP | 4-80578 | A | 3/1992 |
| JP | 4-93567 | A | 3/1992 |
| JP | 11-023113 | A | 1/1999 |
| JP | 11-153371 | A | 6/1999 |
| JP | 2001-336805 | A | 12/2001 |
| JP | 2003-186947 | A | 7/2003 |
| JP | 2005-114295 | A | 4/2005 |
| JP | 2006-125275 | A | 5/2006 |

(Continued)

OTHER PUBLICATIONS

Chinese Office Action dated Jun. 5, 2013, issued in corresponding Chinese Patent Application No. 20110026955.0 (11 pages), with English translation.

(Continued)

*Primary Examiner* — Mohamed Charioui
(74) *Attorney, Agent, or Firm* — Westerman, Hattori, Daniels & Adrian, LLP

(57) ABSTRACT

Design COP is iteratively computed. Provided is a centrifugal chiller performance evaluation system including a data acquisition section for acquiring operating data from a centrifugal chiller as input data; a storage section storing a design COP estimation formula obtained by adding correction values corresponding to losses occurring in an actual environment to a computational formula for ideal actual-machine COP expressed using COP characteristics of a reverse Carnot cycle; and a computing section for estimating a design COP at a current operating point using the operating data acquired by the data acquisition section and the design COP estimation formula stored in the storage section. The correction values include a first correction value calculated from a first computational formula including the load factor of the centrifugal chiller as a variable and a second correction value calculated from a second computational formula including a difference between cooling water outlet temperature and chilled water outlet temperature as a variable. The second correction value contains an offset from the first correction value depending on cooling water inlet temperature.

5 Claims, 8 Drawing Sheets

(56) References Cited

FOREIGN PATENT DOCUMENTS

| | | | |
|---|---|---|---|
| JP | 2009-204262 | A | 9/2009 |
| JP | 2010-43826 | A | 2/2010 |
| JP | 2011-100792 | A | 6/2011 |
| KR | 10-0466433 | B1 | 1/2005 |
| KR | 10-0511934 | B1 | 9/2005 |
| KR | 10-0776324 | B1 | 11/2007 |
| WO | 2008/142714 | A1 | 11/2008 |
| WO | 2009/107295 | A1 | 9/2009 |

OTHER PUBLICATIONS

Korean Notice of Allowance mailed Jul. 18, 2012, issued in corresponding Korean Patent Application No. 10-2011-0001606, w/English translation.

Decision to Grant a Patent dated Dec. 4, 2013, issued in corresponding Chinese Patent Applicaton No. 201110026955.0, w/English explanation of relevance (3 pages).

Korean Office Action dated Nov. 11, 2011, issued, in Korean Patent Application No. 2010-0034271 with English translation (6 pages).

Korean Decision to Grant a Patent dated Aug. 1, 2012 issued in Korean patent application No. 10-2010-0034271 (2 pages).

Extended European Search Report dated Nov. 21, 2012, issued in European Patent Application No. 10160661.4 (4 pages).

Chinese Decision to Grant dated Dec. 5, 2012, issued in Chinese Patent Application No. 201010170046, (2 pages).

Japanese Decision to Grant a Patent dated Nov. 5, 2013 issued in Japanese Patent Application No. 2009-265296 with English translation (6 pages).

R. P. Lapina, "How to use performance curves to evaluate behavior of centrifugal compressors", Jan. 25, 1982, pp. 47-54. Procon, Inc.

U.S. Non-Final Office Action dated Oct. 17, 2013, issued in related U.S. Appl. No. 12/763,699 (17 pages).

Japanese Decision to Grant a Patet dated Mar. 11, 2014, issued in Japanese Patent Application No. 2010-170665 with English translation (6 pages).

* cited by examiner

CENTRIFUGAL CHILLER PERFORMANCE EVALUATION SYSTEM

BACKGROUND OF THE INVENTION

1. Field of the Invention

The present invention relates to performance evaluation systems for centrifugal chillers that include fixed-speed turbocompressors.

This application is based on Japanese Patent Application No. 2010-170665, the content of which is incorporated herein by reference.

2. Description of Related Art

Recently, the need for performance evaluation of centrifugal chillers has been growing with the increasing social concern about reductions in energy consumption and $CO_2$ emissions as countermeasures against global warming. In general, the performance of centrifugal chillers is evaluated using a measure called the coefficient of performance (COP) (see, for example, Japanese Unexamined Patent Application, Publication No. HEI-11-23113). The COP is calculated from the following formula, where a higher COP is evaluated as having a higher energy efficiency.

COP=cooling capacity[kW]/power consumption[kW]

One possible method for allowing the user to accurately determine the performance of a centrifugal chiller is to show how high the current COP (hereinafter referred to as "measured COP") is with respect to the maximum COP that can be achieved by the centrifugal chiller in terms of its performance (hereinafter referred to as "design COP"). In this case, because the design COP of the centrifugal chiller varies constantly with, for example, chilled water temperature, cooling water temperature, load factor, and the amount of refrigerant circulated, iterative calculation of the design COP is essential for showing the user how the measured COP compares with the design COP.

In the related art, however, the calculation of the design COP requires determining, for example, the performance of the heat exchanger and compressor constituting the centrifugal chiller and the thermal properties of the refrigerant from an enormous amount of operating data from the centrifugal chiller and inputting it to a dedicated program for carrying out a large number of convergent calculations. Accordingly, it is impractical to iteratively calculate the constantly varying design COP, and it is almost impossible to handle such calculation of the design COP in a refrigerator control panel which has a limited throughput.

BRIEF SUMMARY OF THE INVENTION

An object of the present invention, which has been made in light of such circumstances, is to provide a centrifugal chiller performance evaluation system that enables iterative calculation of design COP.

To solve the above problem, the present invention employs the following solutions.

An aspect of the present invention is a performance evaluation system for a centrifugal chiller including a fixed-speed turbocompressor. The centrifugal chiller performance evaluation system includes a data acquisition section for acquiring operating data from the centrifugal chiller as input data; a storage section storing a design COP estimation formula obtained by adding correction values corresponding to losses occurring in an actual environment to a computational formula for ideal actual-machine COP expressed using COP characteristics of a reverse Carnot cycle; and a computing section for estimating a design COP at a current operating point using the operating data acquired by the data acquisition section and the design COP estimation formula stored in the storage section. The correction values include a first correction value calculated from a first computational formula including the load factor of the centrifugal chiller as a variable and a second correction value calculated from a second computational formula including a difference between cooling water outlet temperature and chilled water outlet temperature as a variable. The second correction value contains an offset from the first correction value depending on cooling water inlet temperature.

According to the above aspect, the characteristics of the ideal actual-machine COP in an ideal environment are expressed using the computational formula showing the COP characteristics of the reverse Carnot cycle, and the losses varying with the load factor and the cooling water inlet temperature are expressed by the first correction value determined by the load factor and the second correction value calculated from the second computational formula including the difference between cooling water outlet temperature and chilled water outlet temperature as a variable. In this way, the computational formula for the design COP, which is expressed by an extremely complicated computational formula in the related art, can be sufficiently expressed by a simple computational formula to perform iterative computation of the design COP. In addition, the above performance evaluation system provides the notable advantage of allowing even a device having a limited throughput, such as a centrifugal chiller control panel, to perform iterative computation of the design COP.

In the above centrifugal chiller performance evaluation system, if the centrifugal chiller is operated at a design point of rated specification conditions that is different from a design point of rated specification conditions on which the design COP estimation formula is based, the first correction value may be calculated using a load factor in which a change in the specific volume of a refrigerant due to the difference between the design points is compensated for.

In this way, an error due to a design point of rated specification conditions can be eliminated so that the design COP computational formula has higher versatility.

In the above centrifugal chiller performance evaluation system, the second correction value may contain a temperature compensation for heat loss occurring during heat exchange.

Because heat loss occurring during heat exchange in the centrifugal chiller is compensated for, the design COP can be calculated with higher precision.

The above centrifugal chiller performance evaluation system may further include a display section for displaying the design COP calculated by the computing section together with a current measured COP.

Because the display section is provided, the design COP and the measured COP calculated by the computing section can both be provided to the user.

The above centrifugal chiller performance evaluation system may be installed in a control panel of a centrifugal chiller.

For example, if design COP is calculated by a device installed at another site remote from a centrifugal chiller, operating data acquired from the centrifugal chiller must be transmitted to that device in real time via, for example, a communication medium. On the other hand, the operating data is constantly input to the control panel of the centrifugal chiller to control the centrifugal chiller. If the control panel has the function of calculating the design COP, the design COP can be calculated using the operating data used for control. This eliminates the need for the burdensome data communication described above.

The present invention provides the advantage of allowing iterative computation of the design COP.

DETAILED DESCRIPTION OF THE INVENTION

A centrifugal chiller performance evaluation system according to an embodiment of the present invention will now be described with reference to the drawings.

Figure 1:
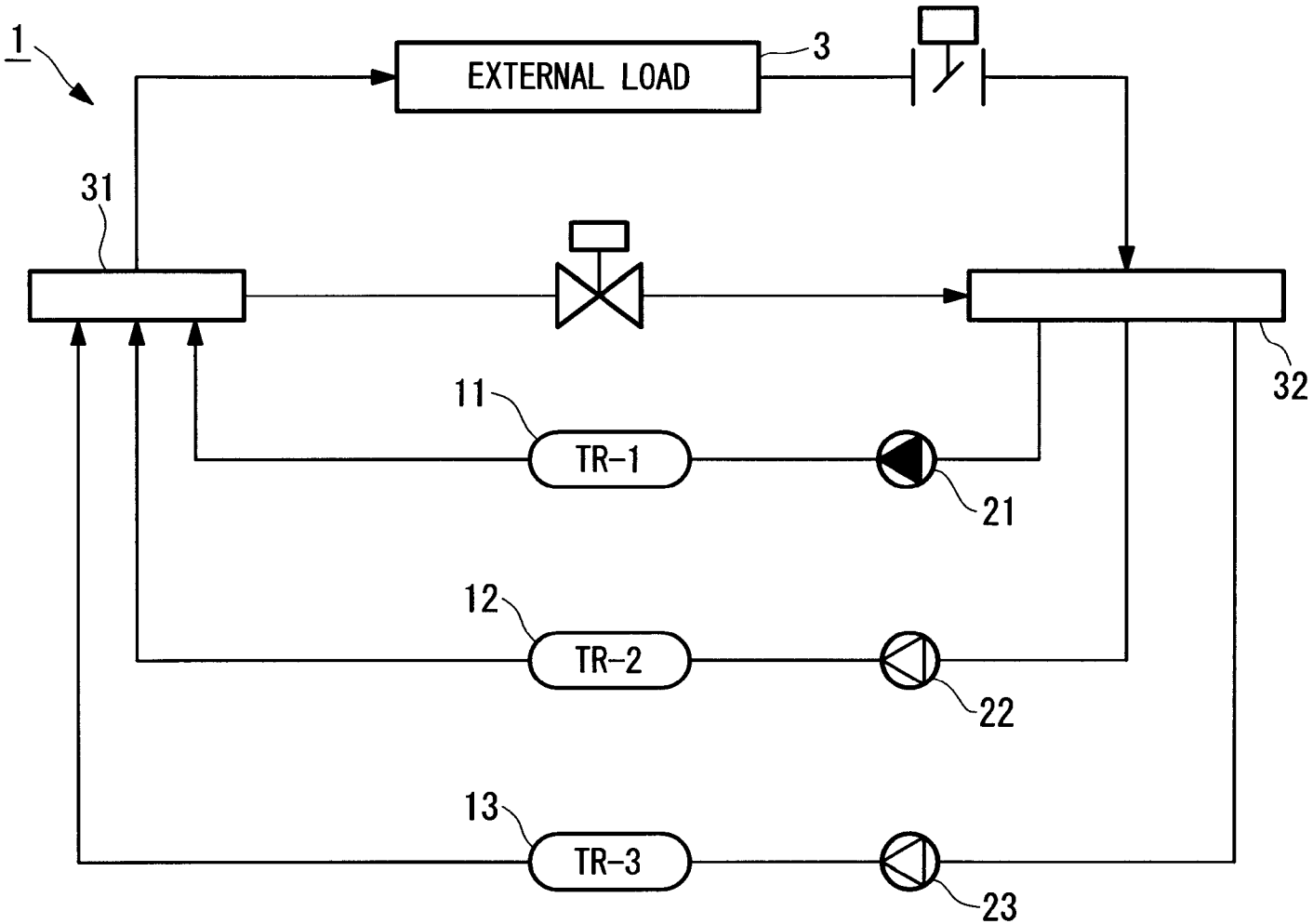
FIG. 1 is a diagram schematically showing the configuration of a heat source system including centrifugal chillers according to an embodiment of the present invention.
Figure 2:
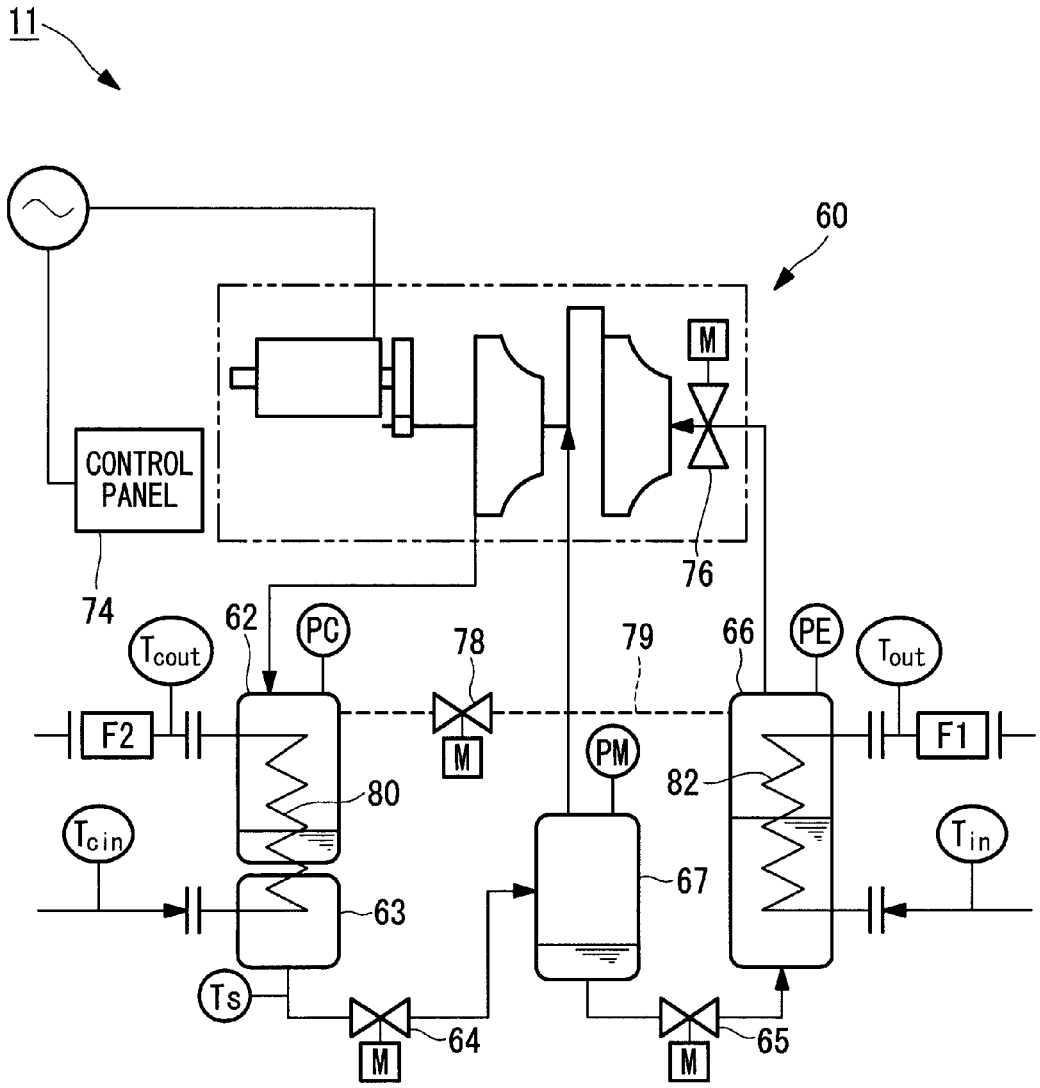
FIG. 2 is a diagram showing the detailed configuration of a centrifugal chiller according to an embodiment of the present invention.

First, the arrangement of centrifugal chillers to which the centrifugal chiller performance evaluation system is applied will be briefly described using FIGS. 1 and 2. FIG. 1 is a diagram schematically showing the configuration of a heat source system including centrifugal chillers according to this embodiment. A heat source system 1 is installed in, for example, a building or plant facility and includes three centrifugal chillers 11, 12, and 13 for cooling chilled water (heat medium) supplied to an external load 3 such as an air conditioner or a fan coil. These centrifugal chillers 11, 12, and 13 are arranged in parallel with the external load 3.

Chilled water pumps 21, 22, and 23 for pumping the chilled water are disposed upstream of the centrifugal chillers 11, 12, and 13, respectively, as viewed along the flow of the chilled water. These chilled water pumps 21, 22, and 23 feed chilled water coming from a return header 32 to the respective centrifugal chillers 11, 12, and 13. The chilled water pumps 21, 22, and 23 are driven by inverter motors that allow the rotational speeds thereof to be changed for variable flow rate control.

The chilled water passing through the centrifugal chillers 11, 12, and 13 is collected in a supply header 31. The chilled water collected in the supply header 31 is supplied to the external load 3. After being heated through the external load 3 by, for example, air conditioning, the chilled water is fed to the return header 32. The chilled water is split by the return header 32 and, as described above, is fed to the centrifugal chillers 11, 12, and 13.

FIG. 2 shows the detailed configuration of the centrifugal chiller 11. Here, the centrifugal chiller 11 will be described as a representative example because the centrifugal chillers 11, 12, and 13 have the same configuration.

The centrifugal chiller 11 is configured to implement a two-stage compression, two-stage expansion subcooling cycle. Specifically, the centrifugal chiller 11 includes a turbocompressor 60 for compressing a refrigerant, a condenser 62 for condensing the high-temperature, high-pressure gas refrigerant compressed by the turbocompressor 60, a subcooler 63 for supercooling the liquid refrigerant condensed by the condenser 62, a high-pressure expansion valve 64 for expanding the liquid refrigerant from the subcooler 63, an intermediate cooler 67 connected to the high-pressure expansion valve 64, to an intermediate stage of the turbocompressor 60, and to a low-pressure expansion valve 65, and an evaporator 66 for evaporating the liquid refrigerant expanded by the low-pressure expansion valve 65.

The turbocompressor 60 is a fixed-speed two-stage centrifugal compressor that operates at a constant rotational speed. An inlet guide vane (hereinafter referred to as "IGV") 76 for controlling the flow rate of intake refrigerant is disposed at a refrigerant inlet of the turbocompressor 60 to allow capacity control of the centrifugal chiller 11.

The condenser 62 has a condensed refrigerant pressure sensor PC for measuring condensed refrigerant pressure.

The subcooler 63 is disposed downstream of the condenser 62 along the flow of the refrigerant so as to supercool the condensed refrigerant. A temperature sensor Ts for measuring the refrigerant temperature after the supercooling is disposed immediately downstream of the subcooler 63 along the flow of the refrigerant.

The condenser 62 and the subcooler 63 have a cooling heat transfer surface 80 for cooling them. The flow rate of cooling water is measured by a flow meter F2, the cooling water outlet temperature is measured by a temperature sensor Tcout, and the cooling water inlet temperature is measured by a temperature sensor Tcin. The cooling water releases heat outside in a cooling tower (not shown) and is then guided again to the subcooler 63 and the condenser 62.

The intermediate cooler 67 has a pressure sensor PM for measuring intermediate pressure.

The evaporator 66 has a pressure sensor PE for measuring evaporation pressure. The evaporator 66 absorbs heat to yield chilled water at a rated temperature (for example, 7° C.). The evaporator 66 has a cooling heat transfer surface 82 for cooling the chilled water supplied to the external load. The flow rate of the chilled water is measured by a flow meter F1, the chilled water outlet temperature is measured by a temperature sensor Tout, and the chilled water inlet temperature is measured by a temperature sensor Tin.

A hot gas bypass pipe 79 is disposed between a vapor phase section of the condenser 62 and a vapor phase section of the evaporator 66. In addition, a hot gas bypass valve 78 is disposed in the hot gas bypass pipe 79 to control the flow rate of the refrigerant flowing therethrough. The flow rate of the hot gas bypass can be controlled by the hot gas bypass valve 78 to allow capacity control within an extremely narrow range where the control by the IGV 76 is insufficient.

In FIG. 2, the values measured by the sensors, such as the pressure sensor PC, are transmitted to a control panel 74. The control panel 74 also controls the degrees of opening of the IGV 76 and the hot gas bypass valve 78.

Although the condenser 62 and the subcooler 63 are provided in the centrifugal chiller 11 shown in FIG. 2 to heat the cooling water that has released heat outside in the cooling tower by heat exchange between the cooling water and the refrigerant, for example, the condenser 62 and the subcooler 63 may be replaced by an air heat exchanger for heat exchange between outside air and the refrigerant in the air heat exchanger. In addition, the centrifugal chillers 11, 12, and 13 are not limited to those having a cooling function as described above; for example, they may have only a heating function or both a cooling function and a heating function. In addition, the medium subjected to heat exchange with the refrigerant may be water or air.

Next, the performance evaluation of the centrifugal chiller 11 executed by the control panel 74 of the centrifugal chiller 11, particularly, a method for calculating design COP, will be described with reference to the drawings.

The control panel 74 includes, for example, a central processing unit (CPU) (not shown), a random access memory (RAM), and a computer-readable recording medium. A set of procedures for implementing various functions, described later, are recorded in, for example, the recording medium in the form of programs, and the CPU loads the programs into the RAM and executes information processing and computing to implement the various functions, described later.

Figure 3:
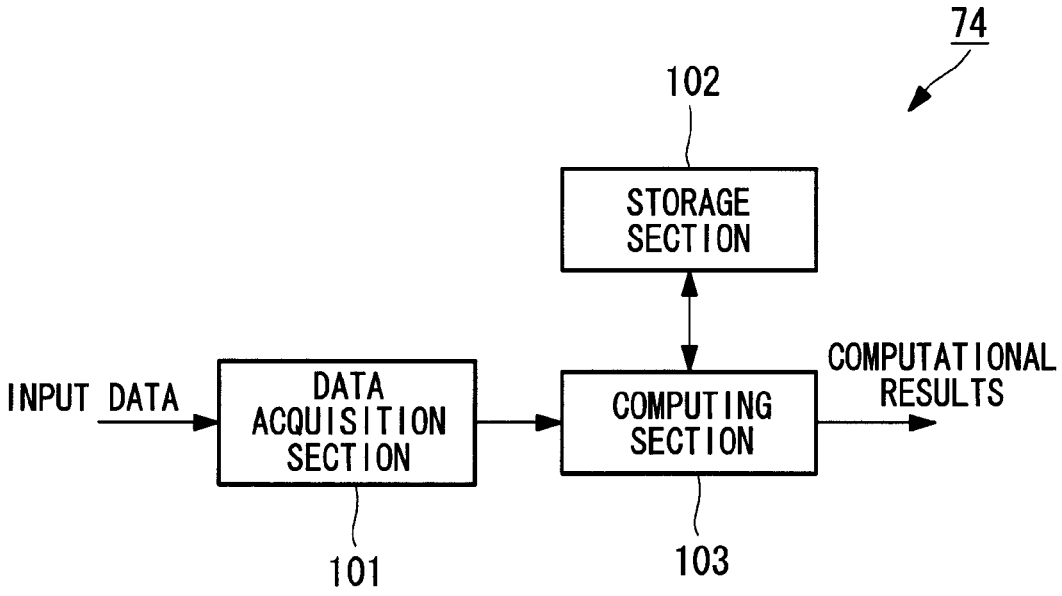
FIG. 3 is a functional block diagram showing the functions of a control panel shown in FIG. 2.

FIG. 3 is a functional block diagram showing the functions of the control panel 74. As shown in FIG. 3, the control panel 74 includes a data acquisition section 101, a storage section 102, and a computing section 103.

The data acquisition section 101 acquires operating data from the centrifugal chiller 11 as input data. Examples of the operating data include the cooling water inlet temperature measured by the temperature sensor Tcin, the chilled water outlet temperature measured by the temperature sensor Tout, the chilled water inlet temperature measured by the temperature sensor Tin, and the current load factor.

The storage section 102 stores various computational formulas for calculating the design COP. Here, the term "design COP" refers to the maximum COP that can be achieved by a centrifugal chiller in terms of its performance at each operating point.

The various computational formulas used for estimation of the design COP will now be described.

First, the design COP can be determined on the basis of a COP calculated in an ideal environment free from, for example, mechanical loss in the same refrigeration cycle as an actual machine (hereinafter referred to as "ideal actual-machine COP") by taking into account losses occurring in an actual environment.

Focusing on the fact that the characteristics of the ideal actual-machine COP are nearly identical to the COP characteristics of the reverse Carnot cycle, this embodiment estimates the design COP by employing a calculation formula for the COP characteristics of the reverse Carnot cycle as a calculation formula for the ideal actual-machine COP and adding corrections corresponding to various losses to the calculation formula.

In this way, the calculation formula for the COP characteristics of the reverse Carnot cycle can be employed as the calculation formula for the ideal actual-machine COP to express the ideal actual-machine COP by a quite simple mathematical formula.

The design COP is given by formula (1) below.

$$COP_{ct}=COPcarnot/Cf \quad (1)$$

$$COPcarnot=(T_{LO}+273.15)/(T_{HO}-T_{LO}+T_d) \quad (2)$$

In formula (1) above, $COP_{ct}$ is the design COP, COPcarnot is the ideal actual-machine COP, and Cf is a correction value for various losses.

In addition, the ideal actual-machine COP is expressed by formula (2), where $T_{LO}$ is the chilled water outlet temperature, $T_{HO}$ is the cooling water outlet temperature, and $T_d$ is a correction value. While the calculation for the reverse Carnot cycle usually uses evaporation temperature and condensation temperature, formula (2) above instead uses the chilled water outlet temperature $T_{LO}$ and the cooling water outlet temperature $T_{HO}$, which are relatively easy to measure. Accordingly, the correction value $T_d$ is added to cancel out an error corresponding to heat loss in a heat exchanger. Here, the correction value $T_d$ is a constant.

In this embodiment, additionally, the above cooling water outlet temperature $T_{HO}$ is determined by computing using the cooling water inlet temperature $T_{HI}$ and the load factor K for formula (3) below.

$$T_{HO}=(T_{HOSP}-T_{HISP})*K/Fr_{ct}+T_{HI} \quad (3)$$

In formula (3), $T_{HOSP}$ is a preset value of the cooling water outlet temperature under rated specification conditions, $T_{HISP}$ is a preset value of the cooling water inlet temperature under rated specification conditions, K is the load factor of a refrigerator, $Fr_{ct}$ is the ratio of the current flow rate of cooling water to a preset value of the flow rate of cooling water under rated specification conditions, and $T_{HI}$ is the cooling water inlet temperature.

Next, the above correction value Cf will be described. The correction value can be determined by actually acquiring data on the COP characteristics of an actual machine, that is, the COP characteristics of an actual machine suffering various losses (hereinafter referred to as "actual-machine COP characteristics"), and comparing the actual-machine COP characteristics with the ideal actual-machine COP characteristics calculated using formula (2) above.

Figure 4:
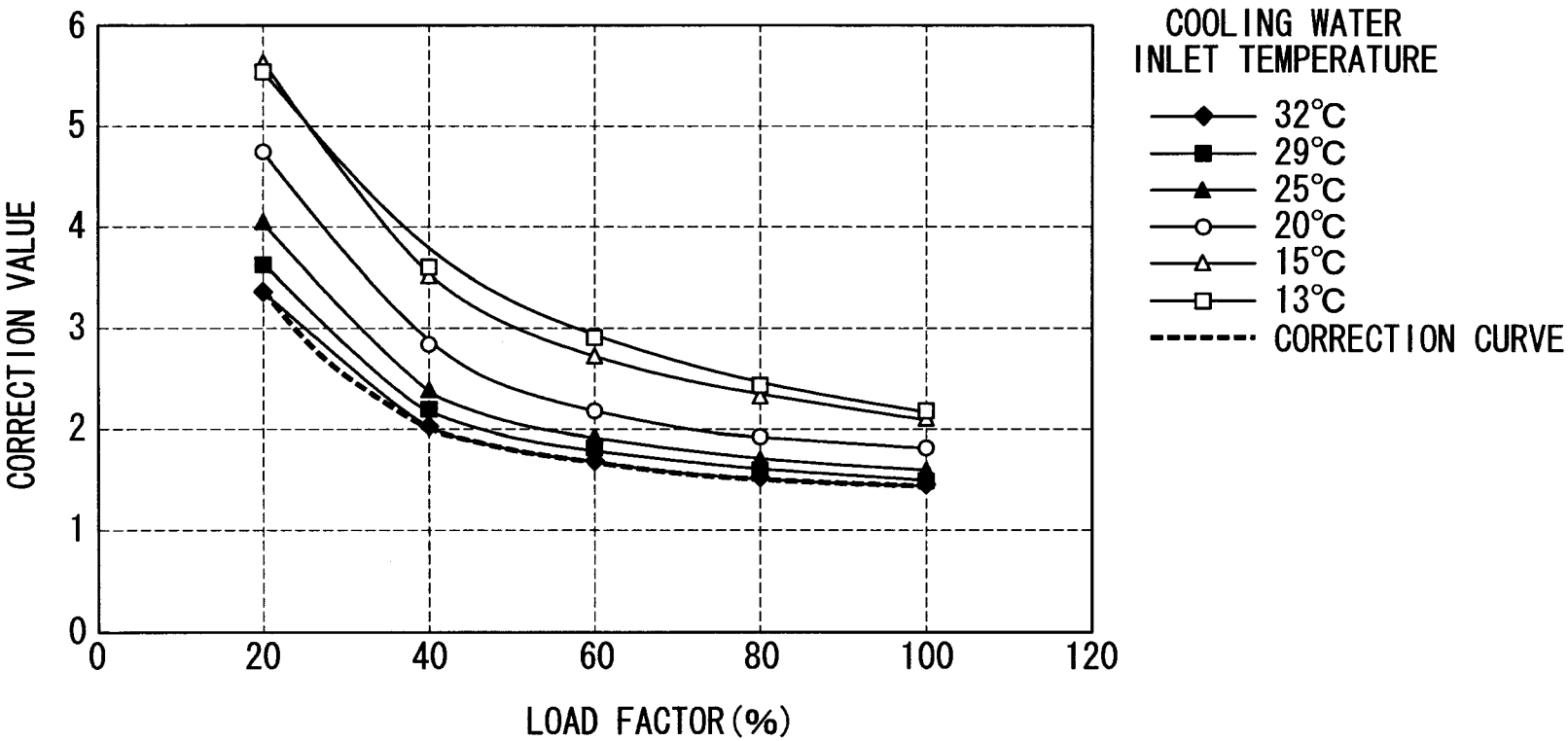
FIG. 4 is a diagram showing correspondences between load factor and correction value at various cooling water inlet temperatures.

Thus, operating data was actually acquired using an actual machine at various cooling water inlet temperatures and load factors, and the actual-machine COP was calculated from the operating data and was used to create the graph shown in FIG. 4. In FIG. 4, the horizontal axis indicates the load factor (%) of the centrifugal chiller, and the vertical axis indicates the ideal actual-machine COP divided by the actual-machine COP, in other words, the correction value Cf. The ideal actual-machine COP used here is based on the same refrigeration cycle and refrigerant properties as the actual machine.

As shown in FIG. 4, the characteristics of the correction value against the load factor vary with the cooling water inlet temperature. Accordingly, one possible method for calculating the design COP is to store correspondences between the load factor and the correction value at various cooling water inlet temperatures in advance, retrieve the correction value corresponding to the cooling water inlet temperature and load factor at the current operating point from the above correspondences, and substitute the retrieved correction value into formula (1) above. This method, however, involves increased amounts of data and processing complexity because correspondences between the load factor and the correction value at various cooling water inlet temperatures must be stored in advance.

Here, according to the correspondences between the load factor and the correction value at the various cooling water inlet temperatures shown in FIG. 4, each curve has substantially the same curvature. That is, the correspondence between the load factor and the correction value at each cooling water inlet temperature can be expressed by shifting one curve in the y-axis direction.

In this embodiment, based on the above characteristics, a correction curve is derived from the characteristic curves at the various cooling water inlet temperatures shown in FIG. 4, and a polynomial equation (hereinafter referred to as "first computational formula") representing the correction curve is used to determine the correction value corresponding to the current load factor. In addition, a shift in the y-axis direction due to a difference in cooling water inlet temperature is incorporated into the correction value Td contained in the computational formula for the ideal actual-machine COP expressed by formula (2) above to further simplify the computational formula.

Formula (4) is a first computational formula for calculating a correction value $Cf_1$ (the correction value Cf expressed by formula (4) is hereinafter referred to as "first correction value"). Formula (5) is a second computational formula for calculating the correction value Td into which an offset from the first correction value $Cf_1$ due to a difference in cooling water inlet temperature is incorporated, namely, a correction value Td' (this correction value is hereinafter referred to as "second correction value").

$$Cf_1=f_1(K) \tag{4}$$

$$Td'=f_2(T_{HO}-T_{LO})=a*(T_{HO}-T_{LO})+b \tag{5}$$

In formula (4), the first computational formula $f_1(K)$ is given by a polynomial equation representing the correction curve shown in FIG. 4. In other words, the first correction value $Cf_1$ is determined by a polynomial equation including the load factor K as a variable.

In formula (5), a and b are constants. As shown in formula (5), the second correction value Td' is given by a linear function including the difference between the cooling water outlet temperature $T_{HO}$ and the chilled water outlet temperature $T_{LO}$ as a variable.

The second correction value Td' will now be described.

Unlike a variable-speed machine, a fixed-speed machine cannot follow variations in operating status by controlling the rotational speed of a compressor. Instead, the capacity control is carried out by, for example, IGV control, and the device loss depends primarily on the degree of IGV opening.

Figure 5:
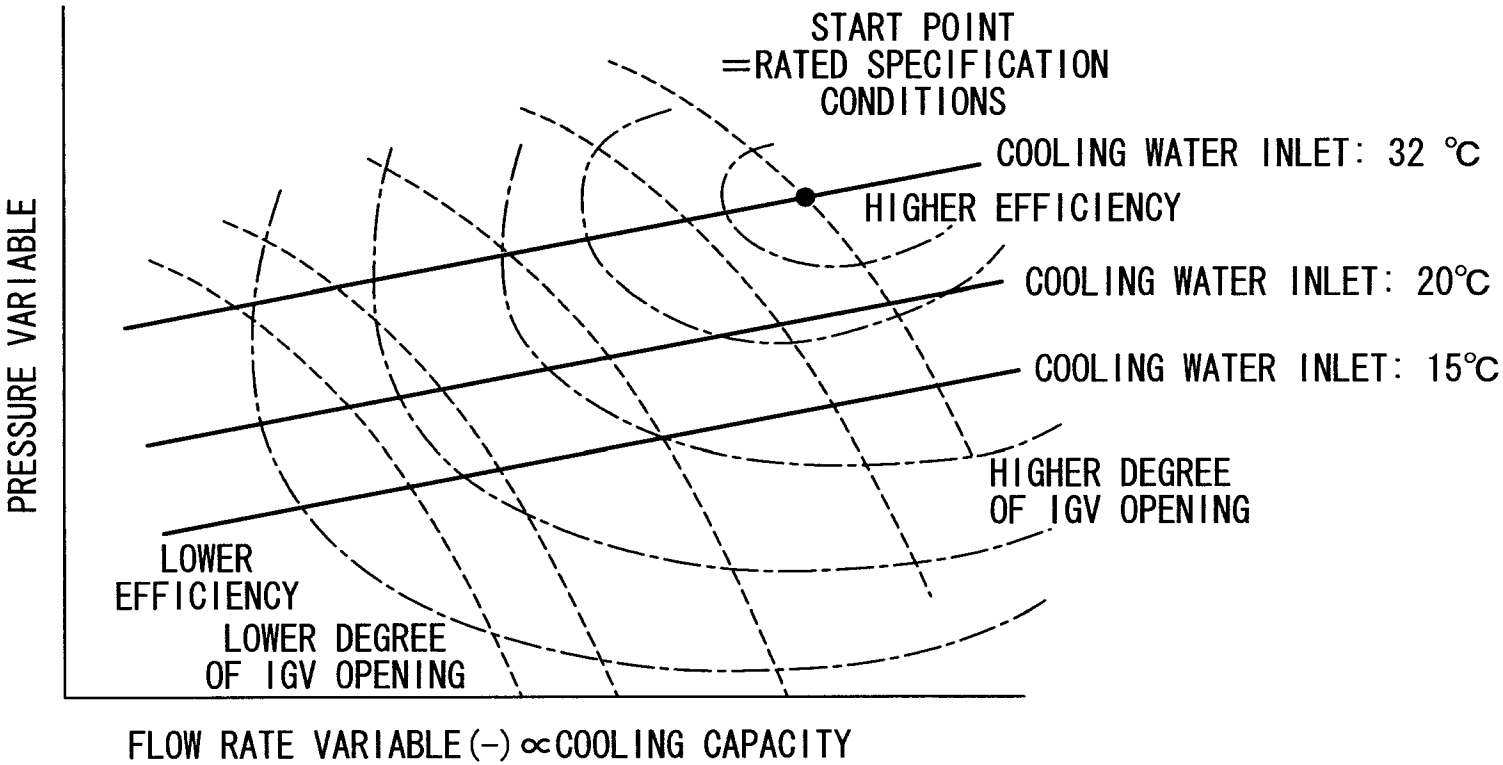
FIG. 5 shows correspondences between flow rate variable and pressure variable at various cooling water inlet temperatures, degrees of IGV opening, and efficiencies.

FIG. 5 shows correspondences between flow rate variable and pressure variable at various cooling water inlet temperatures, degrees of IGV opening, and efficiencies. In FIG. 5, the horizontal axis indicates the flow rate variable, the vertical axis indicates the pressure variable, the solid lines indicate the characteristics at the various cooling water inlet temperatures, the broken lines indicate the characteristics at the various degrees of IGV opening, and the one-dot chain lines indicate the correspondences at the various efficiencies. The cooling capacity is proportional to the flow rate variable. The pressure variable means the pressure difference between the evaporator 66 and the condenser 62, corresponding to the difference between the cooling water outlet temperature $T_{HO}$ and the chilled water outlet temperature $T_{LO}$.

In FIG. 5, the correspondence between the flow rate variable and the pressure variable at each cooling water inlet temperature has nearly the same gradient, and the amount of change in pressure variable with a change in cooling water inlet temperature is constant at the same degree of IGV opening. Hence, the second correction value proportional to the pressure variable, that is, the difference between the cooling water outlet temperature $T_{HO}$ and the chilled water outlet temperature $T_{LO}$, can be used to compensate for a shift in the y-axis direction of the correction curvature shown in FIG. 4, thus allowing appropriate expression of the amount of change in loss due to a difference in cooling water inlet temperature.

Accordingly, a design COP estimation formula is finally given by formula (6) below.

$$COP_{ct}=\{(T_{LO}+273.15)/(T_{HO}-T_{LO}+Td')\}/Cf_1 \tag{6}$$

In this embodiment, to simply calculate the design COP, the COP calculated from the reverse Carnot cycle is used instead of the ideal actual-machine COP, which should originally be used for the design COP estimation formula. This results in a slight error. To eliminate the error, the design COP iteratively calculated using the design COP estimation formula of formula (6) above is corrected as shown in formula (7) below.

$$COP_{ct}'=COP_{ct}*COP_{rp}/COP_{dp} \tag{7}$$

In formula (7) above, $COP_{ct}'$ is the corrected design COP, $COP_{ct}$ is the design COP iteratively estimated using formula (6), $COP_{rp}$ is a more precise value of design COP determined in advance by a predetermined program at a design point of rated specification conditions, and $COP_{rp}$ is the design COP calculated using formula (6) above at the design point of the rated specification conditions. In this way, the design COP can be more precisely estimated by multiplying the design COP iteratively calculated using the design COP estimation formula of formula (6) by a correction value ($COP_{rp}/COP_{dp}$) obtained by dividing the design COP determined in advance by a predetermined program at a design point of rated specification conditions by the design COP calculated using formula (6) at the design point of the rated specification conditions.

Figure 6:
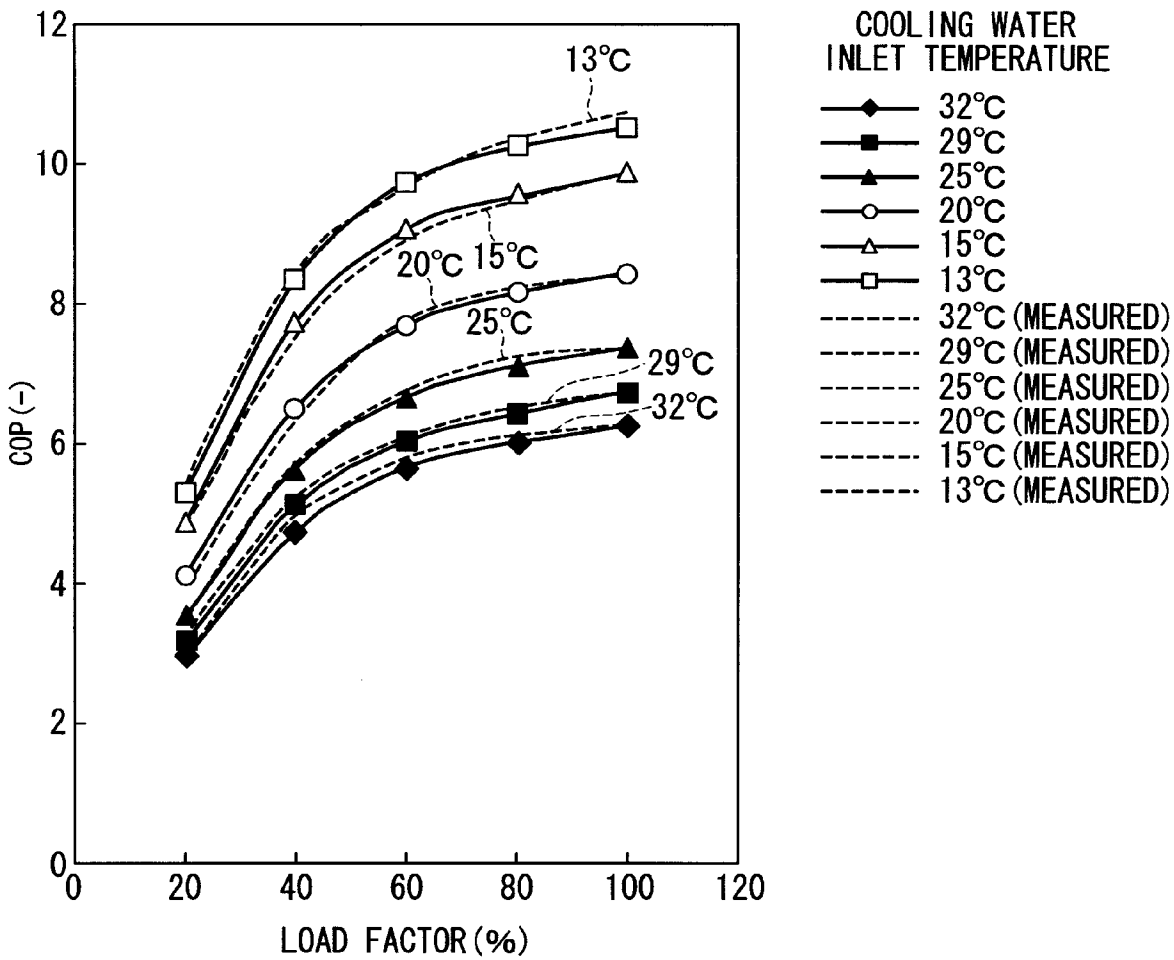
FIG. 6 is a graph showing a comparison between design COP calculated using a design COP estimation formula and design COP actually measured using an actual machine.

FIG. 6 is a graph showing a comparison between the design COP calculated using formula (6) above and corrected using formula (7) (hereinafter referred to as "computed design COP") and the design COP actually measured using an actual machine (hereinafter referred to as "measured design COP"). In FIG. 6, the solid lines indicate the computed design COP, and the broken lines indicate the measured design COP. As shown in FIG. 6, the characteristics of the computed design COP and the measured design COP at various cooling water inlet temperatures were nearly identical, thus demonstrating reproducibility.

Thus, it has found that the design COP at each operating point can be determined with sufficient precision using the design COP estimation formula given by adding the first correction value $Cf_1$ and the second correction value Td', which correspond to losses occurring under an actual environment, to the computational formula for the ideal actual-machine COP expressed using the COP characteristics of the reverse Carnot cycle.

Next, a process executed by the control panel 74 during the operation of the centrifugal chiller 11 will be described with reference to FIG. 7.

First, the information required for calculation of the design COP is stored in the storage section 102 in advance, including formulas (3) to (6) above, associated computational formulas for calculation of various parameters used in these computational formulas, and preset values of rated specification conditions.

Figure 7:
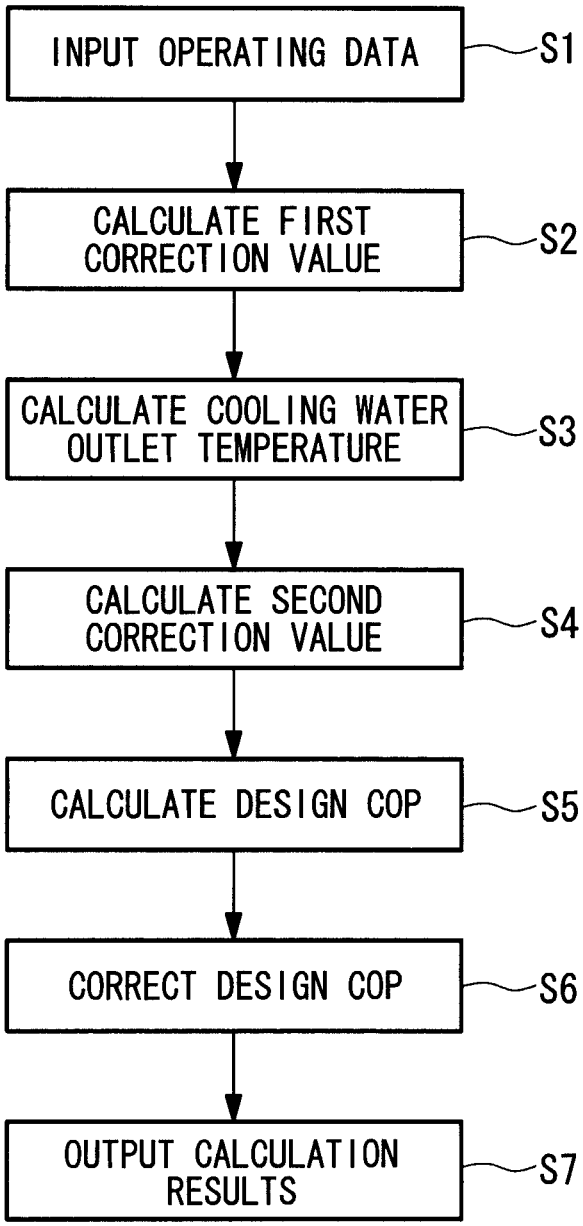
FIG. 7 is a flowchart showing a process executed by a control panel to estimate design COP.

During the operation of the centrifugal chiller 11, the data acquisition section 101 acquires, for example, the current cooling water inlet temperature, load factor, and flow rate of cooling water as input data at predetermined timings and outputs the input data to the computing section 103 (Step S1 in FIG. 7).

After the data acquisition section 101 acquires the input data, the computing section 103 retrieves various computational formulas from the storage section 102 and uses them to estimate the design COP at the current operating point.

Specifically, the computing section 103 calculates the first correction value $Cf_1$ using formula (4) above (Step S2), calculates the cooling water outlet temperature $T_{HO}$ using formula (3) (Step S3), calculates the second correction value Td' by adding the cooling water outlet temperature $T_{HO}$ obtained in Step S3 to formula (5) (Step S4), calculates the design COP by adding the first correction value $Cf_1$ obtained in Step S2 and the second correction value Td' obtained in Step S4 to formula (6) (Step S5), and corrects the design COP calculated in Step S5 using formula (7) (Step S6).

In addition, although a detailed description is omitted, the control panel 74 calculates, for example, the heat output and the measured COP at the current operating point (heat output (kW) divided by power consumption (kW)) in parallel with the above calculation of the design COP.

The design COP (correction values), measured COP, heat output, etc. calculated by the control panel 74 and the measured power consumption are transmitted to a monitoring device (not shown) via a communication medium and are displayed on a monitor of the monitoring device (Step S7). This allows the user to check the performance values displayed on the monitor of the monitoring device to determine how the measured COP compares with the design COP, thus enabling more efficient operation.

According to the centrifugal chiller performance evaluation system according to this embodiment, as described above, because the ideal actual-machine COP is expressed by the computational formula for the COP of the reverse Carnot cycle, the characteristics of the ideal actual-machine COP can be expressed by a simple computational formula. In addition, because the correction values corresponding to losses occurring in an actual environment, namely, the first correction value $Cf_1$ determined from the first computational formula including the load factor as a variable and the second correction value Td' containing the amount of correction corresponding to the offset from the first correction value $Cf_1$ depending on the cooling water inlet temperature, are added to the computational formula for the COP of the reverse Carnot cycle, the characteristics of the actual-machine COP, which depend on the load factor and the cooling water inlet temperature, can be sufficiently incorporated into the above computational formula for the COP of the reverse Carnot cycle so that the design COP at each operating point can be determined with sufficient precision.

In addition, because the computational formula for computing the design COP can be expressed by a simple computational formula, even a device having a limited throughput, such as the control panel 74, can perform iterative computation of the design COP.

Thus, the centrifugal chiller performance evaluation system according to this embodiment provides the notable advantage of allowing calculation of the design COP with sufficient precision in real time.

If a centrifugal chiller is operated under rated specification conditions (hereinafter referred to as "rated specification conditions (secondary)") different from rated specification conditions on which the component configuration conditions of the centrifugal chiller are based (hereinafter referred to as "rated specification conditions (primary)"), for example, if a centrifugal chiller is operated at a design point with a different chilled water temperature, the specific volume of the refrigerant must be corrected because the degree of IGV opening varies with varying specific volume of the refrigerant. Formula (8) is a first computational formula taking into account the correction of the specific volume of the refrigerant.

$$Cf_2=f_1(K') \quad (8)$$

where $0<K'\leq 1$.

$$K'=K^*(v_T/v_{sp}) \quad (9)$$

In formula (9), $v_T$ is the specific volume of the refrigerant taken into the compressor under the rated specification conditions (secondary), and $v_{sp}$ is the specific volume of the refrigerant taken into the compressor under the rated specification conditions (primary).

In addition, formula (8) is evaluated with K'=1 if K'>1, and with K'=0 if K'<0.

In this way, the specific volume of the refrigerant can be corrected to eliminate an error due to a design point so that the computational formula for the design COP stored in the control panel 74 has higher versatility.

Figure 8:
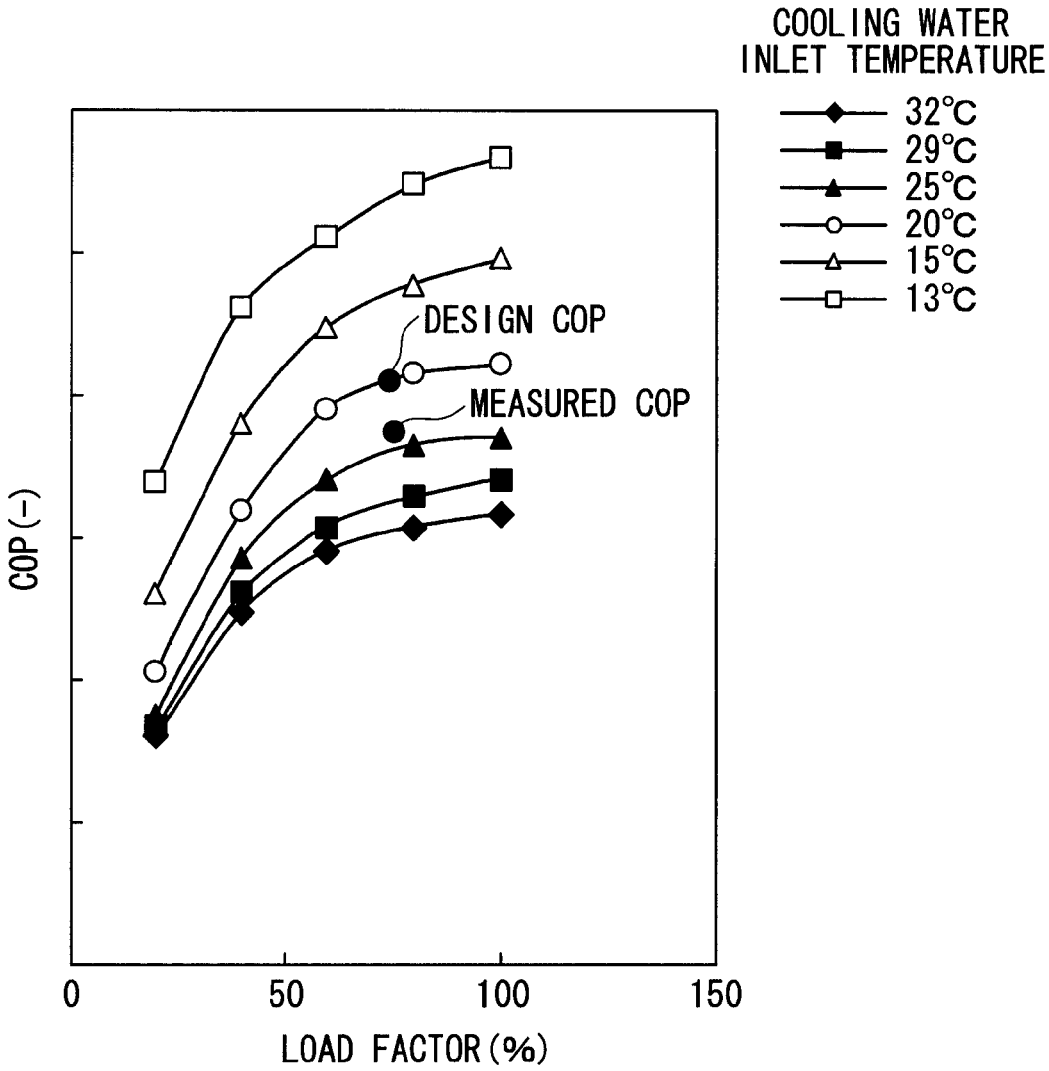
FIG. 8 is a graph showing an example of how design COP and measured COP are displayed.

In the above embodiment, additionally, the manner of displaying the design COP and the measured COP on the monitor of the monitoring device is not particularly limited. For example, the design COP and the measured COP may be directly displayed, or the measured COP divided by the design COP may be displayed. In addition, as shown in FIG. 8, the measured COP and the design COP at the current operating point may be plotted and displayed on a graph showing the characteristics of the load factor and the design COP at various cooling water inlet temperatures.

What is claimed is:

1. A performance evaluation system for a centrifugal chiller including a fixed-speed turbocompressor, comprising:

a data acquisition section for acquiring operating data from the centrifugal chiller as input data;

a storage section storing a design COP estimation formula obtained by adding correction values corresponding to losses occurring in an actual environment to a computational formula for ideal actual-machine COP expressed using COP characteristics of a reverse Carnot cycle; and a computing section for estimating a design COP at a current operating point using the operating data acquired by the data acquisition section and the design COP estimation formula stored in the storage section;

wherein the correction values include a first correction value calculated from a first computational formula including the load factor of the centrifugal chiller as a variable and a second correction value calculated from a second computational formula including a difference between cooling water outlet temperature and chilled water outlet temperature as a variable, the second correction value containing an offset from the first correction value depending on cooling water inlet temperature.

2. The centrifugal chiller performance evaluation system according to claim 1, wherein if the centrifugal chiller is operated at a design point of rated specification conditions that is different from a design point of rated specification conditions on which the design COP estimation formula is based, the first correction value is calculated using a load factor in which a change in the specific volume of a refrigerant due to the difference between the design points is compensated for.

3. The centrifugal chiller performance evaluation system according to claim 1, wherein the second correction value contains a temperature compensation for heat loss occurring during heat exchange.

4. The centrifugal chiller performance evaluation system according to claim 1, further comprising a display section for displaying the design COP calculated by the computing section together with a current measured COP.

5. A centrifugal chiller comprising a control panel in which the centrifugal chiller performance evaluation system according to claim 1 is installed.

* * * * *